US011585055B1

(12) United States Patent
Sun et al.

(10) Patent No.: US 11,585,055 B1
(45) Date of Patent: Feb. 21, 2023

(54) HIGH EFFICIENCY TRAFFICE SIGN WITH PROJECTION LIGHT SOURCE

(71) Applicant: National Central University, Taoyuan (TW)

(72) Inventors: Ching-Chern Sun, Taoyuan (TW); Sihi-Kang Lin, Tainan (TW); Chi-Shou Wu, Taoyuan (TW)

(73) Assignee: NATIONAL CENTRAL UNIVERSITY, Taoyuan (TW)

( * ) Notice: Subject to any disclaimer, the term of this patent is extended or adjusted under 35 U.S.C. 154(b) by 0 days.

(21) Appl. No.: 17/699,965

(22) Filed: Mar. 21, 2022

(51) Int. Cl.
*E01F 9/615* (2016.01)
*G09F 13/02* (2006.01)

(52) U.S. Cl.
CPC ..... *E01F 9/615* (2016.02); *G09F 13/02* (2013.01)

(58) Field of Classification Search
CPC ..... E01F 9/615; G09F 13/02
USPC ..... 40/612, 615, 624
See application file for complete search history.

(56) References Cited

U.S. PATENT DOCUMENTS 3,790,431 A * 2/1974 Tung ..... F21V 11/14 428/338
4,084,339 A * 4/1978 Peltier ..... G09F 13/02 40/560
4,952,023 A * 8/1990 Bradshaw ..... G09F 13/04 362/23.18
4,954,935 A * 9/1990 Hammond ..... G09F 13/02 40/560
2013/0291414 A1* 11/2013 Cegnar ..... F21V 5/04 40/559

FOREIGN PATENT DOCUMENTS

JP 08049218 A * 2/1996 ..... G02B 5/128
JP 11224067 A * 8/1999 ..... G09F 13/02
JP 2005202282 A * 7/2005 ..... G09F 13/02

* cited by examiner

*Primary Examiner* — Gary C Hoge
(74) *Attorney, Agent, or Firm* — Guice Patents PLLC

(57) ABSTRACT

A high efficiency traffic sign includes a retroreflective film and a diffuser film. The retroreflective film is located between the body of the traffic sign and the diffuser film so as to form an indication face. The traffic sign is located higher than a road and the indication face faces coining vehicles on the road. A projection light source module is located on one side of the road and emits a light beam toward the traffic sign and the light beam covers the indication face. The light beam passes through the diffuser film and reaches retroreflective film. The light beam is then reflected and passes through the diffuser film again, the diffuser film changes the reflective path of the light beam which passes through the diffuser film to form a diversified light beam to allow the drivers of the coining vehicles on the road to see the traffic sign clearly.

9 Claims, 7 Drawing Sheets

HIGH EFFICIENCY TRAFFICE SIGN WITH PROJECTION LIGHT SOURCE

BACKGROUND OF THE INVENTION

1. Fields of the Invention

The present invention relates to a high efficiency traffic sign, and more particularly, to a high efficiency traffic sign with a projection light source to increase visibility from distance.

2. Descriptions of Related Art

Traffic signs provide important information for drivers so as to guide the vehicles to safely use the roads and avoid from traffic incidents. However, the visibility decreases at night, and the driver's vision is blurred and cannot clearly see the traffic signs from distance. A common practice in the early days was to set a light source below the traffic signs, and the light source illuminates the traffic signs from bottom of the traffic sings. Another method is to have the traffic signs with reflective films so as to provide illumination and reflective properties by the vehicle headlight to increase the visibility of the traffic signs to drivers. Chinese Utility model Publication No. 206887808 discloses a combination of the two mentioned above.

It is noted that the light source light source located at the bottom of the traffic signs cannot illuminate the upper portion of the traffic sign. In addition, during maintenance, the road must be closed and climbing equipment must be used for replacement and maintenance. Besides, when a traffic sign equipped with a reflective film is used at a curve section of the road, because the vehicle headlight cannot reach the traffic sign, there are still problems of visibility for the drivers. Furthermore, the reflective film can only be functioned at a specific angle, and the drivers who are not within the range of the reflection angle cannot clearly identify the traffic signs.

The present invention intends to provide a high efficiency traffic sign with a projection light source to increase visibility from distance, to eliminate the shortcomings mentioned above.

SUMMARY OF THE INVENTION

The present invention relates to a high efficiency traffic sign with projection light source and comprises a traffic sign including a body, a retroreflective film and a diffuser film. Two opposite sides of the retroreflective film are respectively connected between the body and the diffuser film so as to form an indication face of the traffic sign. The traffic sign is located higher than a road, and the indication face faces the coining vehicles on the road.

A projection light source module is located on one side of the road and positioned at a distance from the traffic sign. When the projection light source module emits a light beam toward the traffic sign and the light beam covers the indication face, the light beam passes through the diffuser film and reaches retroreflective film and is reflected. When the reflected light beam passes through the diffuser film again, the diffuser film changes the reflective path of the light beam and the light beam passes through the diffuser film to form a diversified light beam. The diversified light beam faces the coining vehicles on the road such that the indication face can be clearly seen by the drivers of the coining vehicles at distance.

The primary object of the present invention is to provide a high efficiency traffic sign with projection light source, and the traffic sign can be seen by the drivers of the coining vehicles clearly at distance. The high efficiency traffic sign is easily maintained simply by maintaining the projection light source module. When maintaining the projection light source module, the road does not need to be blocked, and the projection light source module can be easily replaced.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
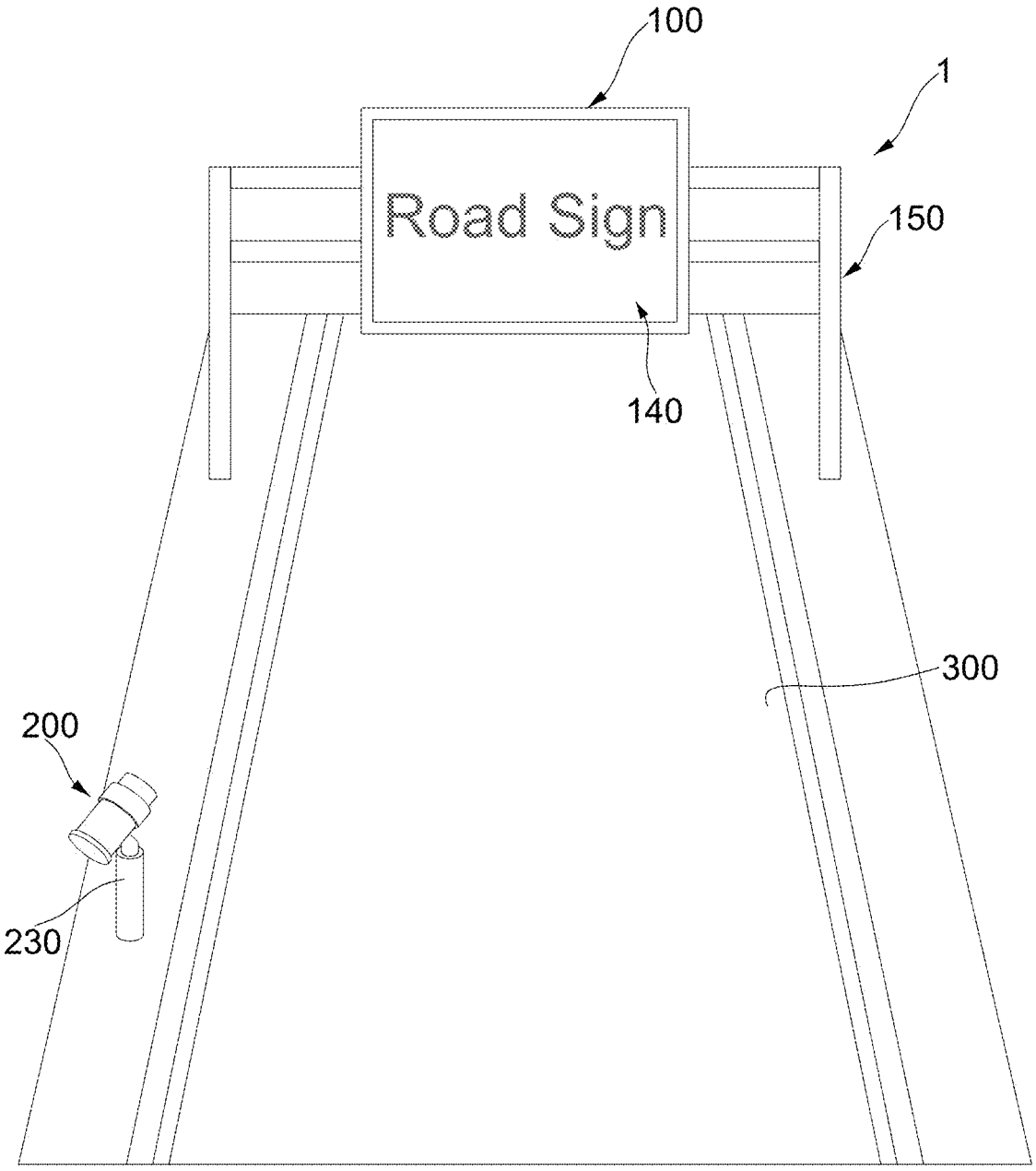
FIG. 1 illustrates the high efficiency traffic sign of the present invention is installed above the road of the present invention.
Figure 2:
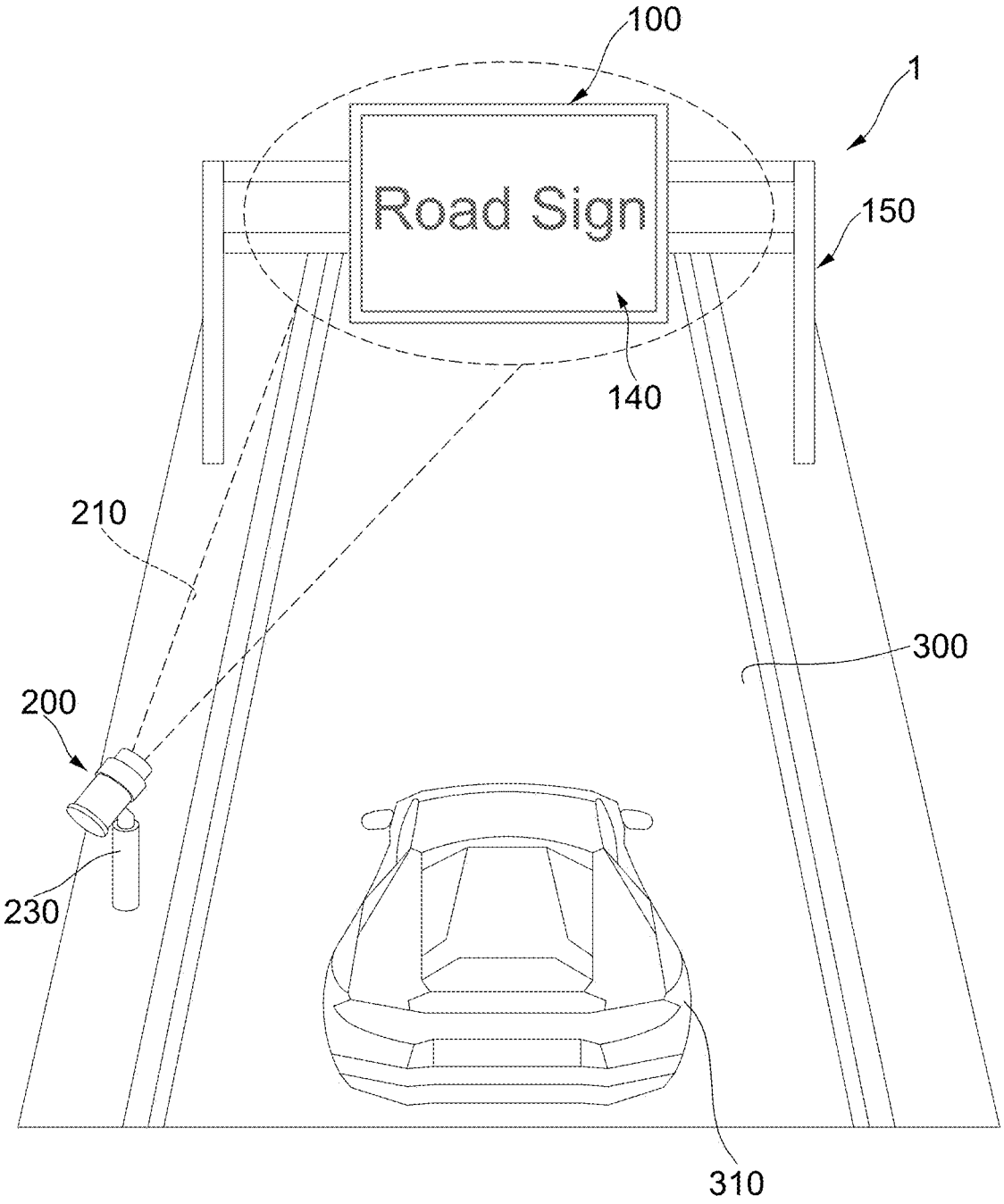
FIG. 2 illustrates that the projection light source module emits a light beam toward the high efficiency traffic sign of the present invention.
Figure 3:
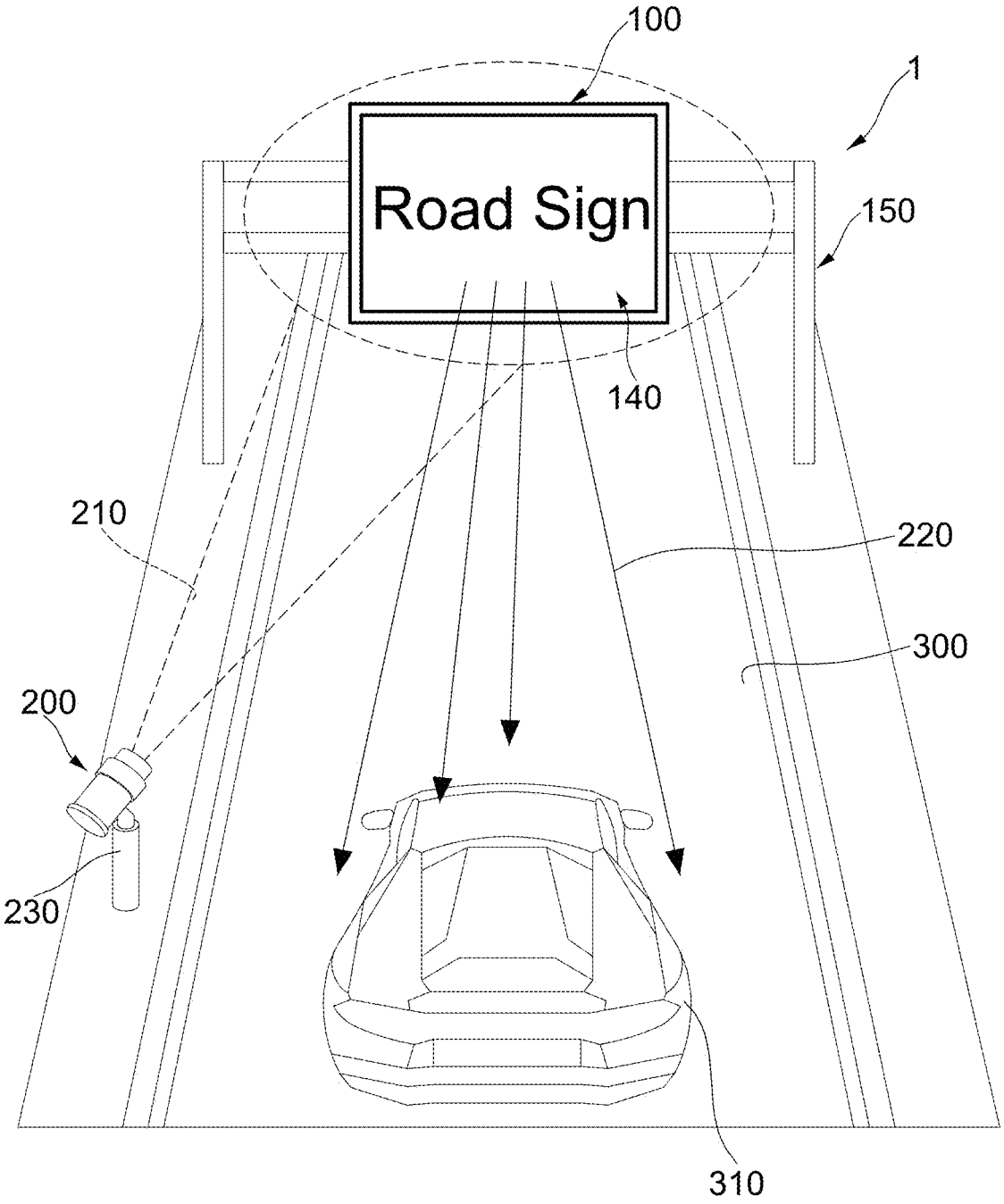
FIG. 3 illustrates that the light beam projects toward the indication face of the high efficiency traffic sign of the present invention and is reflected and diversified.
Figure 4:
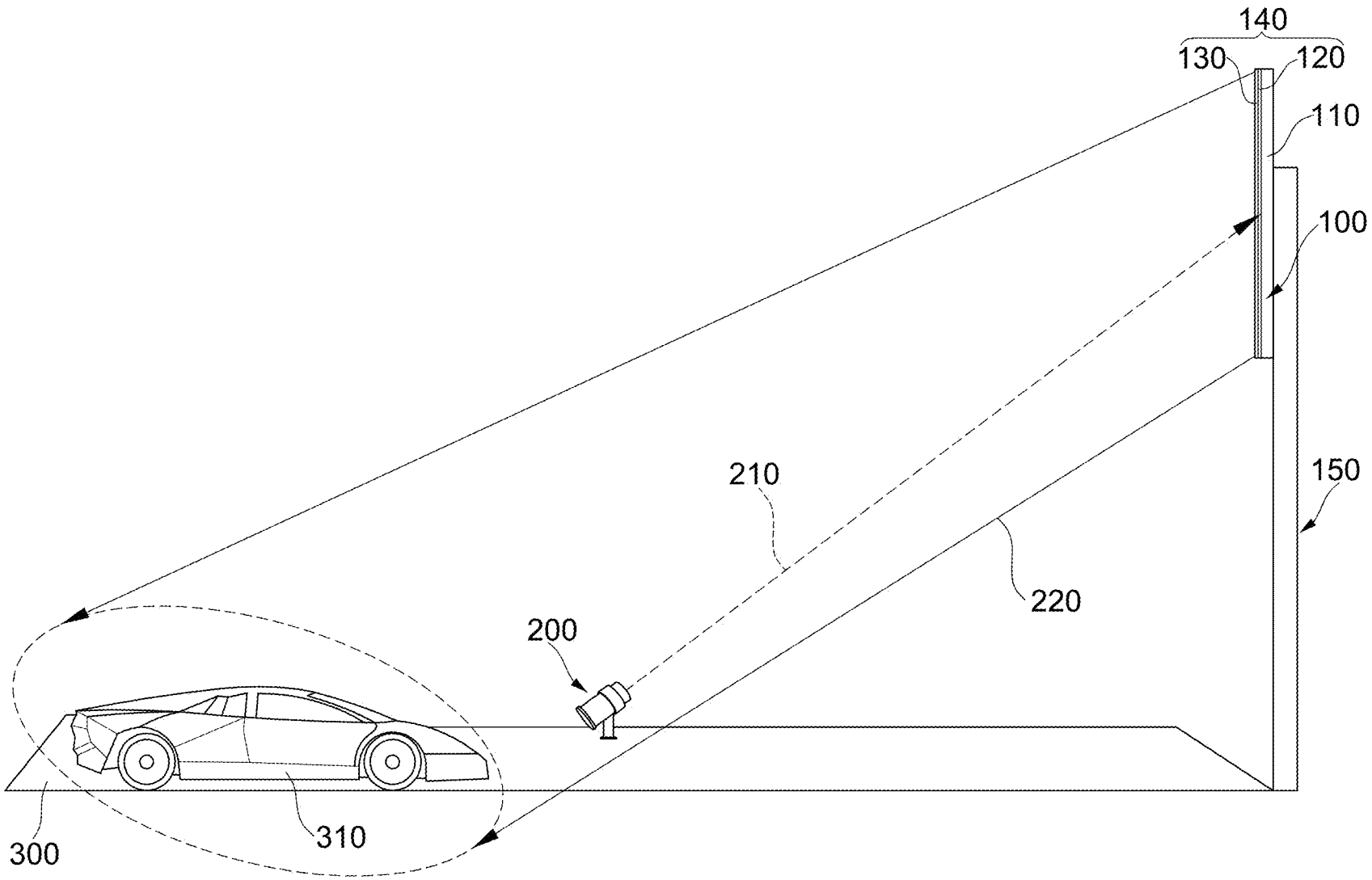
FIG. 4 illustrates the operation of the high efficiency traffic sign of the present invention.
Figure 5:
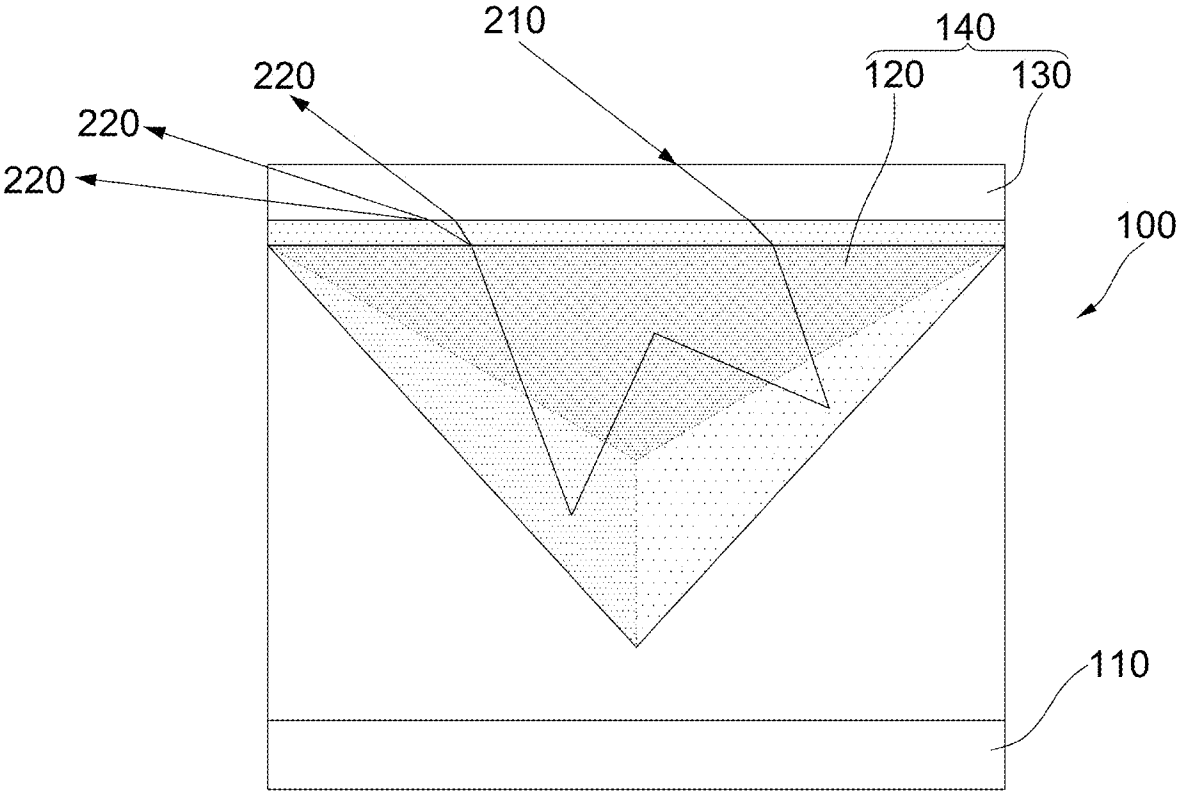
FIG. 5 shows the path of the light beam that passes through the diffuser film and the retroreflective film.

Referring to FIGS. 1 to 5, the high efficiency traffic sign with projection light source 1 comprises a traffic sign 100 including a body 110, a retroreflective film 120 and a diffuser film 130. The two opposite sides of the retroreflective film 120 are respectively connected between the body 110 and the diffuser film 130 so as to form an indication face 140 of the traffic sign 100. The traffic sign 100 is located above a road 300, and the indication face 140 faces the coining vehicles 310 on the road 300. A projection light source module 200 is located on one side of the road 300 and positioned at a distance from the traffic sign 100.

When the projection light source module 200 emits a light beam 210 toward the traffic sign 100 and the light beam covers the indication face 140, the light beam 210 passes through the diffuser film 130 and reaches retroreflective film 120 and is reflected. When the reflected light beam 210 passes through the diffuser film 130 again, the diffuser film 130 changes the reflective path of the light beam 210, and the light beam 210 passes through the diffuser film 130 to form a diversified light beam 220. The diversified light beam 220 faces the coming vehicles 310 on the road 300.

When in use, the projection light source module 200 is activated and emits a light beam 210 toward the traffic sign 100 and the light beam covers the whole indication face 140. The light beam 210 passes through the diffuser film 130 and reaches retroreflective film 120 and is reflected. When the reflected light beam 210 passes through the diffuser film 130 again, the diffuser film 130 changes the reflective path of the light beam 210, and the light beam 210 passes through the diffuser film 130 to form a diversified light beam 220. The diversified light beam 220 faces the coming vehicles 310 on the road 300, so that the drivers can clearly see the indication face 140 of the traffic sign 100. The indication face 140 is bright and clear, and does not need to be illuminated by the headlights of the vehicles. Therefore, the drivers of the vehicles and pedestrians can see the content on the indication face 140.

The high efficiency traffic sign of the present invention is easily maintained. The traffic sign 100 includes a simple structure which can be used for a long period of time without too much maintenance. The maintenance is focused on the projection light source module 200 which is located on one side of the road 300 so that when maintaining the projection light source module 200, the road 300 does not need to be blocked, and the workers maintain the projection light source module 200 on the side of the road 300. The damaged projection light source module 200 can be easily replaced.

The projection light source module 200 is turned on after sunset and is turned off during the daytime. The projection light source module 200 can be turned on the weather of fog or heavy rain to provide clear indication to the drivers and pedestrians.

The projection light source module 200 includes a light source and an optical component. The optical component includes a lens or a reflection cup, or a combination of the lens and the reflection cup. The projection light source module 200 is able to adjust the position of the lens or the reflection cup to change the focus of the light beam, such that the scattering angle and the projection direction of the light beam 210 can be adjusted. Therefore, the projection light source module 200 can be installed at different heights and controls the angle of the reflective surface of the traffic sign 100.

The light beam 210 of the projection light source module 200 emits the light beam that includes more than two colors of different wave lengths of visible light. For example, the projection light source module 200 emits white light beam and yellow light beam to be used in different environmental conditions. The white light beam is used during sunset and night so as to illuminate the traffic sign 100. The yellow light beam is used in for and heavy rain weather to illuminate the traffic sign 100. The light source emits a visible light with white light wave length and a visible light with yellow light wave length. Alternatively, the optical component changes the color of the light from the light source for the projection light source module 200.

When using the projection light source module 200, a frame 150 is located on the road side and extends above the road 300. The traffic sign 100 connected to the frame 150.

Figure 6:
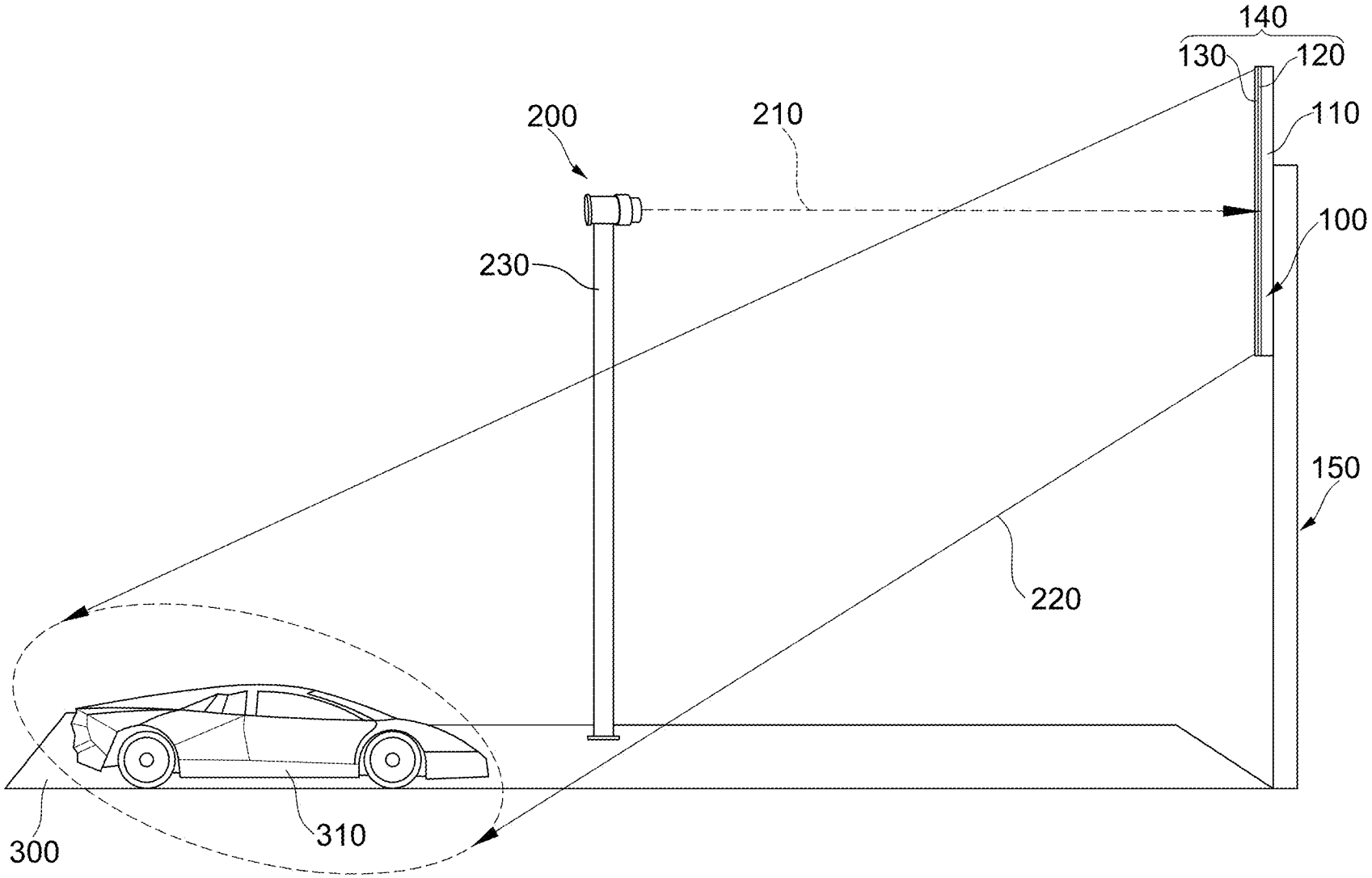
FIG. 6 illustrates that the projection light source module is installed on a post and emits a light beam toward the high efficiency traffic sign of the present invention.

Alternatively, a post 230 may be set on one side of the road 300, and the projection light source module 200 is connected to the post 230 and faces upward and toward the traffic sign 100. As shown in FIG. 6, the projection light source module 200 is connected to the post 230 and emits light beam horizontally toward the traffic sign 100. The post 230 allows the projection light source module 200 to be installed higher than the road 300 for convenience of maintenance.

Figure 7:
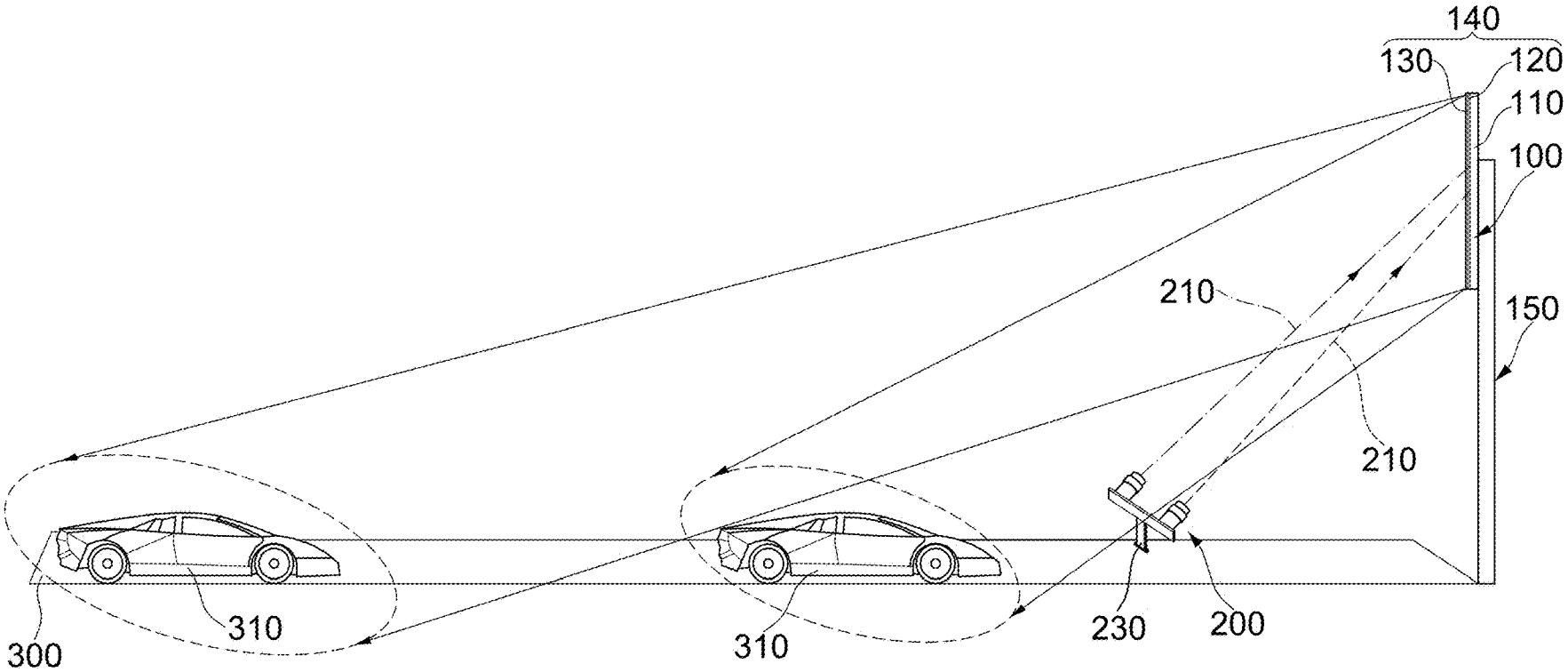
FIG. 7 illustrates that multiple projection light source modules are operated and each of the multiple projection light source modules emits a light beam toward the high efficiency traffic sign of the present invention.

As shown in FIG. 7, the post 230 is set on one side of the road 300, and a plurality of the projection light source modules 200 are connected to the post 230. By the multiple projection light source modules 200 each emitting a light beam 210 toward the traffic sign 100 as shown by dotted lines, and with the cooperation of the lens or the reflection cup, to change the scattering angle and the projection direction. By the features of the retroreflective film 120 and the diffuser film 130, two different diversified light beams 220 are obtained.

IN addition, the traffic sign 100 is one of, or a combination of two of a warning sign, a prohibition sign, an indication sign and an auxiliary sign.

While we have shown and described the embodiment in accordance with the present invention, it should be clear to those skilled in the art that further embodiments may be made without departing from the scope of the present invention.

What is claimed is:

1. A high efficiency traffic sign with projection light source comprising:

a traffic sign including a body, a retroreflective film and a diffuser film, two opposite sides of the retroreflective film respectively connected between the body and the diffuser film so as to form an indication face of the traffic sign, the traffic sign located higher than a road, the indication face facing coining vehicles on the road, and a projection light source module located on one side of the road and positioned at a distance from the traffic sign, when the projection light source module emits a light beam toward the traffic sign and the light beam covers the indication face, the light beam passes through the diffuser film and reaches retroreflective film and is reflected, when the reflected light beam passes through the diffuser film, the diffuser film changes a reflective path of the light beam, the light beam passes through the diffuser film to form a diversified light beam, the diversified light beam faces the coining vehicles on the road.

2. The high efficiency traffic sign with projection light source as claimed in claim 1, wherein the projection light source module includes a light source and an optical component.

3. The high efficiency traffic sign with projection light source as claimed in claim 2, wherein the optical component includes a lens or a reflection cup, or a combination of the lens and the reflection cup.

4. The high efficiency traffic sign with projection light source as claimed in claim 3, wherein the projection light source module adjusts a position of the lens or the reflection cup to change a scattering angle and a projection direction of the light beam.

5. The high efficiency traffic sign with projection light source as claimed in claim 1, wherein the light beam of the projection light source module includes more than two colors of different wave lengths of visible light.

6. The high efficiency traffic sign with projection light source as claimed in claim 1 further comprising a frame located on the road and extending above the road, the traffic sign connected to the frame.

7. The high efficiency traffic sign with projection light source as claimed in claim 1 further comprising a post located on the one side of the road, the projection light source module connected to the post and facing toward the traffic sign.

8. The high efficiency traffic sign with projection light source as claimed in claim 1 further comprising a post located on the one side of the road, a plurality of the projection light source modules connected to the post.

9. The high efficiency traffic sign with projection light source as claimed in claim 1, wherein the traffic sign is one of, or a combination of two of a warning sign, a prohibition sign, an indication sign and an auxiliary sign.

* * * * *